United States Patent [19]

Jürgens

[11] Patent Number: 4,468,762

[45] Date of Patent: Aug. 28, 1984

[54] TELEMETRY EQUIPMENT IN MODULES

[75] Inventor: Rainer Jürgens, Altencelle, Fed. Rep. of Germany

[73] Assignee: Christensen, Inc., Salt Lake City, Utah

[21] Appl. No.: 289,332

[22] Filed: Aug. 3, 1981

[30] Foreign Application Priority Data

Sep. 24, 1980 [DE] Fed. Rep. of Germany ..... 3035905

[51] Int. Cl.[3] ..... G01V 1/40

[52] U.S. Cl. ..... 367/83; 175/50

[58] Field of Search ..... 175/40, 45, 50, 107; 73/151; 340/861; 367/81-85; 181/106; 166/301

[56] References Cited

U.S. PATENT DOCUMENTS

| | | | |
|---|---|---|---|
| 4,007,790 | 2/1977 | Henning | 166/301 X |
| 4,120,097 | 10/1978 | Jeter | 175/45 X |
| 4,139,836 | 2/1979 | Chaney et al. | 367/82 |
| 4,181,014 | 1/1980 | Zuvela et al. | 73/151 |
| 4,246,976 | 1/1981 | McDonald, Jr. | 175/107 |
| 4,383,591 | 5/1983 | Ogura | 181/106 |

*Primary Examiner*—Maynard R. Wilbur
*Assistant Examiner*—K. R. Kaiser
*Attorney, Agent, or Firm*—Rufus M. Franklin

[57] ABSTRACT

A device for the remote control of data out of a drill hole to the earth surface during the operation of a drilling device which comprises a drill bit, a drill string and a pump raising a flushing liquid into the surrounding annular space of the drill hole and downward into flow channels of the drill string, consisting of devices arranged in the drill string for the ascertaining of desired informational data for the conversion of the informational data into a series of electrical control signals for the producing of pressure pulses in the downward directed flow of the flushing liquid as a function of the control signals and for the production of the necessary electrical energy, characterized in such a way that the devices part of a coaxial support within the flow channels of the drill string form a structural unit and are arranged over each other; separated axial sections of the structural unit are grouped and that at least the topmost section of the structural unit is constructed as an independent component and by means of an energizable pick-up tool is detachable from the rest of the structural units from the earth surface and is capable of being pulled up through the flow channel of the drill string to the earth's surface.

8 Claims, 1 Drawing Figure

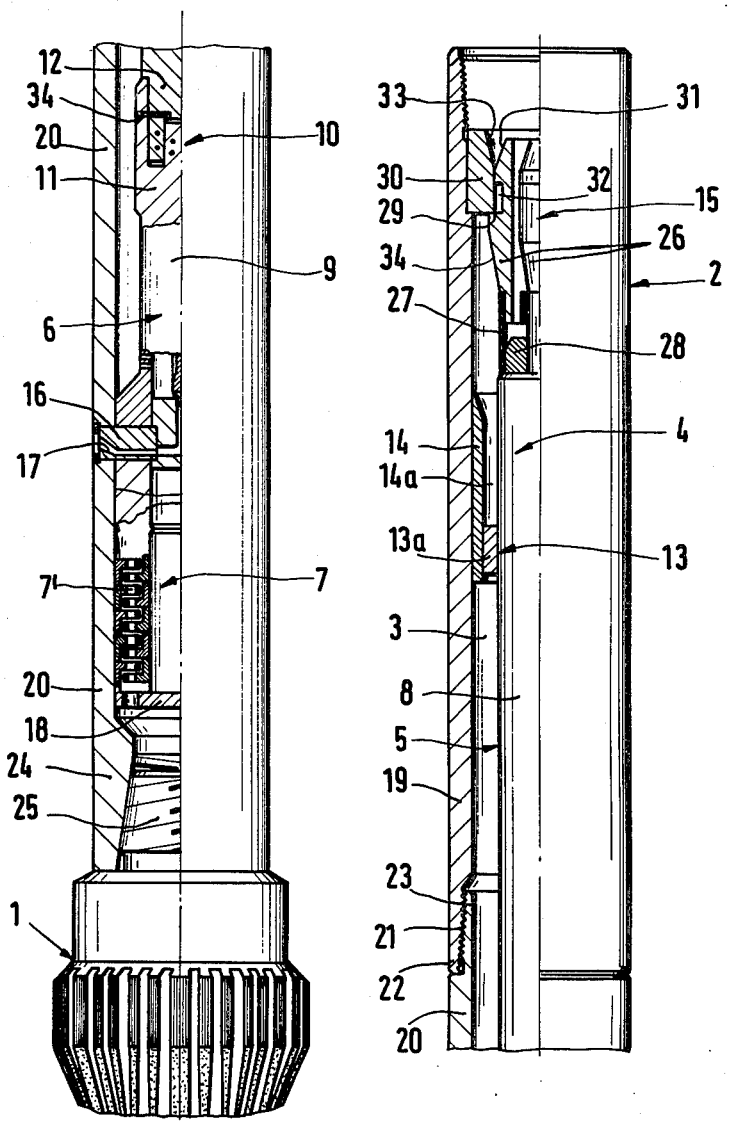
12
34
20
11
10
9
6
16
17
7'
7
20
18
24
25
1
33
31
30
32
29
15
34
26
2
27
28
14
4
14a
13a
13
3
8
5
19
23
21
22
20

TELEMETRY EQUIPMENT IN MODULES

In deep well drilling, it is of considerable importance to obtain information constantly or at periodic intervals from the drill hole to ascertain the data concerning the course of the drilling operation and to permit the necessary precautions which are appropriate to optimize the drilling process and to confront errors or anomalies occurring.

In the past, numerous tests have been undertaken and suggestions made in order to ascertain in each case, desired informational data in the drill hole more or less close to the drill hole bottom and transmit it to the earth surface. In connection therewith, the device with its equipment for ascertaining the informational data, for conversion of the informational data into the electrical control signals as well as generating of the pressure pulses and the required adequate electrical energy near the drill bit is solidly built into the drill string. If, during the drilling operation, an event occurs that parts of the drill string, in particular the drill bit, is seized up in the drill hole during unfavorable formation effects and all efforts to free up the drill string or the drill bit remain in vain, then the drill bit and the attached parts of the drill string as a rule and also the device for information transmission with its very valuable equipment, in particular the one for ascertaining the informational data and for the conversion of the data into control signals with their electrical and/or electronic equipment, is lost.

First of all, the problem of the invention has for its basis to create a device of the kind stated in the beginning which at least is capable of being drawn up out of the drill hole.

This problem is solved according to the invention by means of a refinement of known devices. In this refinement on the basis of the grouping of the individual devices into separate axial sections of the structural unit and by means of the refinement separable from the structural unit at least the topmost independent unit part, a pick-up tool from the earth surface can be used in order to draw out the component through the flow channel of the drill string to the earth surface. In this manner, especially valuable measuring and electronic structural parts in particular of the component can be saved. Also, by means of the pick-up tool, the parts can be lowered and joined functionally with the rest of the structural unit so that, except in the case of a seizure in the drill hole, the section of the structural unit in each case, also in the case of functional disturbances of its structural parts, can be repaired or exchanged on the earth surface without the entire boring tool having to be drawn up.

If, in a further refinement of the invention, at least the topmost section of the structural unit of a tubular body forming a part of the drill string is surrounded by anti-magnetic material, in particular anti-magnetic steel, then this tubular body can be combined with the next lower tubular body of the drill string by means of a conveyable threaded connection by way of an initial stress in the direction of the opening in whose area an effective explosive charge can be attached and be ignited in the opening direction of the threaded connection.

A species of the article of the invention is further explained below with the help of the drawing in whose single, subdivided diagram in a transverse plane and whose righthand component is an upper extension of the left component is illustrated a species of the article of the invention half in an axial section and half in a schematic view.

For the remote control of data from a drill hole to the earth surface during the operation of a drilling device comprising a drill bit 1, and drill string section designated by 2 and a flushing liquid in the flow channel 3 of the drill string 2 is raised upward through the drill bit 1 and into the annular space of the drill hole outside the drill string 2 by a pump (not illustrated). The device 4 consists of devices for the ascertaining of desired informational data by a series of electrical signals which are grouped in a separate axial section 5 of the device 4, a pressure pulse generator 6 which for its part forms a separate axial section of the device 4 and a generator 7 for electrical current production as a further separate axial section of the device 4 which for example, can be driven by means of a turbine 7' by flushing liquid. The device 4 in connection therewith forms a coaxial channel within the flow channel 3 of the drill string 2 for flushing liquid capable of flowing around the structural unit. In the topmost section 5 of the structural unit are comprised collectively devices for the ascertaining of informational data and for converting of the data into control signals including all pertinent electrical and/or electronic instruments.

The topmost section 5 of the structural unit forms an independent component and is, as such, arranged in a separate housing 8 which is separably connected with a housing 9 of the next lower structural unit forming the pressure pulse generator 6. The separably erected section 5 as an independent component from the rest of the structural units is for its part provided with a separable axial electrical signal transmitter connection 10 in the example illustrated in the form of an inductive repeater device 10 comprises in longitudinal section a symmetrically rotating three pronged part 11 formed in the upper end of the housing 9 in which in longitudinal section a symmetrically rotating two pronged part 12 interlocks which makes possible an inductive coupling. For pressure compensation, the enclosed space is connected in the assembly of parts 11 and 12 by means of connecting paths as for example grooves or holes 34' introduced into the flushing space 3.

On the upper end of its housing 8, the device section 5 is provided with a tap catcher 15 with which a pick-up tool let down from the surface through the flushing channel 3 can be connected in order to draw up to the earth surface the device section 5 through the flushing channel 3 by way of release of the electrical connection 10.

In the embodiment illustrated there are supported in the drill pipe string 2 the pressure pulser 6 with its housing 9 by suitable struts or the like supporting members 16, in whose zone drilling fluid connection channels 17 are formed to the annular space surrounding the drill pipe string 2, and the electrical generator 7 by means of a supporting device 18 in such a way that no provision is made for their pulling-up to the earth's surface by means of a catching tool, because the pressure pulser 6 and the generator 7 do not constitute components which are specially valuable. It is nevertheless possible, in addition to the uppermost apparatus section 5, to provide other separable sections of the constructional unit, such as the pressure pulser 6 and the generator 7, with catching mandrels in a suitable manner so that such sections of the constructional unit can also be pulled upwards through the flow channel 3 of the drill pipe string by means of the catching tool.

It is also possible to support detachably the structural unit entirely on at least its topmost section 5 by means of appropriate or well known tubular hanging devices in the drill string which makes possible the withdrawal and reinsertion of the structural unit or individual sections of the same. A detachable coupling device can be provided so that the part of the structural unit containing the pressure pulse generator can be drawn up and can be used again. Moreover, in addition, for a functional connection or reconnection detachable support sections of the structural units in the drill string 2, appropriate centering members or orientation devices for whose automatic coupling and/or orientation in lowering can be provided by means of the pick-up tool for connection with the next lower section of the structural unit.

At 13, the drawing shows such an orientation device which fixes the alignment of the devices for the data determination in section 5 of the structural unit relative to its angular orientation in the drill shaft in lowering the component forcibly.

The orientation device 13 consists of the housing 8 an attached outside lug 13-a which engages a groove 14-a of a sleeve 14 located on the inside surface of the tubular body 19 surrounding the component 5. The groove 14-a in connection therewith is tapered to a funnel shape below.

The tubular body 19 of the drill string which surrounds the topmost device section 5 of the structural unit with the measuring elements and the electrical and/or electronic equipment is, in the example illustrated, formed from a separate tubular body of anti-magnetic material, for example, steel, which shows a part of the drill string 2. The tubular body 19 is connected with the next lower tubular body 20 of the drill string 2 by means of a threaded connection 21 of its threaded sleeve 22 with the threaded journal 23 of the tubular body 20 which again is screwed onto its lower threaded sleeve 24 with an upper threaded journal 25 of the drill bit 1.

If, in the example illustrated, a seizure of the drill bit 1 occurs in the drill hole in the material so that a loosening through rotation and sudden axial forces in rapid succession is no longer possible, then next by means of the pick-up tool by way of attachment to the top catcher 15 of the device section 5 with the measuring elements and the electrical and/or electronic equipment is drawn up; in so doing, the electrical connection 10 is automatically disconnected below the upward directed axial force of the device section 5 acting at the housing 8 so that section 5 can be drawn unimpeded through the flushing channel 3 of the drill string 2. The area of the threaded connection 21 is exposed after that so that an explosive charge from the earth surface can be lowered through the flushing channel 3 of the drill string 2 in the vicinity of the threaded connection 21, and can be attached below the tubular body 19 in order to develop in detonating an effect in the opening direction to the threaded connection 21. After that, the part of the drill string lying above the threaded connection 21 can be completely detached with the help of the explosive charge from the threaded plug 23 of the lowest tubular body 20 and the tubular body 10 made of anti-magnetic material can be drawn up through the drill hole. In this manner, valuable drill shaft or heavy shaft casing material can be saved.

The tap catcher 15 in the example illustrated consists of a radial multi-segmented shaped body in which each segment 26 is connected by way of a flat spring 27 pressing from the outside by a casting part 28 of the component 5 tapering upward. In the inserted position of the component, the front surfaces 29 of the segmented shaped body engage on a casting 30 inserted in back of the tubular body 19 which is fixed by means of the tubular body of the drill string screwed in above it. For extraction of the component 5 a rotationally symmetrical pick-up tool is let down which in sliding over the chamfered surfaces 31 of the segments 26 of the formed body, presses the latter to the inside and grips the back of the front surface of a recess 32 of the segments 26. In connection, therewith, the mechanism of the front surfaces 29 of the segmented formed body is raised up against the collar 30 and the component 5 can be withdrawn.

With the insertion of the component 5 by means of the pick-up tool the chamfered surfaces 33 and 34 on the casing 30 and on the segments 26 produce a contraction of the top caliber 15 pushed through the structure. In the final position, the fixing then takes place by the automatic spreading of the segments 26 to the outside. The pick-up tool in connection therewith becomes free and is withdrawn upward.

What is claimed is:

1. Apparatus for the remote transmission of information from a drill hole to the earth's surface during the operation of a drilling appliance which comprises a rotary drilling bit, a drill pipe string and a pump which delivers drilling fluid downwards in the flow channel of the drill pipe string, through the rotary drilling bit and upwards in the drill hole annular space surrounding the drill pipe string, the apparatus consisting of means in the drill pipe string for the detection of desired information data; for the conversion of the information data into a succession of electrical control signals, for the generation of pressure pulses in the downwardly directed flow of the drilling fluid in dependence on the control signals and for the generation of the required electric energy, said means forming part of a constructional unit, which is coaxially supported inside the flow channel of the drill pipe string and around which drilling fluid can flow, and are grouped in superimposed separate axial sections, at least the uppermost section of the constructional unit being designed as an independent sub unit that is separable from the remainder of the constructional unit by means of a catching tool operable from the earth's surface, and can be pulled upwards to the earth's surface through the flow channel of the drill pipe string.

2. A device according to claim 1 characterized in such a way that a section of the structural unit constructed as an independent component is, by means of the pick-up tool, not only capable of being separated and capable of being pulled up from the rest of the structural unit, but also can be lowered and is capable of being joined functionally with the rest of the structural unit.

3. A device according to claim 1 characterized in such a way that in the topmost section of the structural unit all devices for the ascertaining of informational data and for the conversion of the data into control signals are combined inclusive of all pertinent electrical and/or electronic instruments.

4. A device according to claim 3 characterized in such a way that at the level of the separating joint for the uppermost section of the structural unit, an axially separable electrical signal transmission connection is provided.

5. A device according to claim 1 characterized in such a way that the topmost section of the structural unit is stored in a separate housing which is separable and is connected with a housing or housing part of the next lower section of the structural unit.

6. A device according to claim 5 characterized in such a way that in the connection of the housings an enclosed space is joined by a connecting path with the flow channel serving for pressure equalization.

7. A device according to claim 1 characterized in such a way that the structural unit all together or at least its topmost section is disengagably supported by means of a tube hanging device in the drill string.

8. A device according to claim 1 characterized in such a way that at least the topmost section of the structural unit is surrounded by a tubular body forming a part of the drill string of an anti-magnetic material and there being a screw threaded connection between the tubular body of anti-magnetic material and the next lower tubular body of the drill string an effective explosive charge is installable and ignitable in the opening direction of the threaded connection.

* * * * *